US007426931B2

(12) United States Patent
Miyauchi et al.

(10) Patent No.: US 7,426,931 B2
(45) Date of Patent: Sep. 23, 2008

(54) DISHWASHER

(75) Inventors: Takashi Miyauchi, Hyogo (JP); Hiroaki Inui, Osaka (JP); Fumihiko Sasahara, Nara (JP); Takayuki Inoue, Hyogo (JP); Makoto Oyama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 324 days.

(21) Appl. No.: 10/963,798

(22) Filed: Oct. 14, 2004

(65) Prior Publication Data

US 2005/0081895 A1 Apr. 21, 2005

(30) Foreign Application Priority Data

Oct. 15, 2003 (JP) ..... 2003-354836

(51) Int. Cl.
*B08B 3/10* (2006.01)

(52) U.S. Cl. ..... 134/95.3; 134/186; 134/198

(58) Field of Classification Search ..... 134/186, 134/198, 95.3

See application file for complete search history.

(56) References Cited

U.S. PATENT DOCUMENTS

| | | | | | |
|---|---|---|---|---|---|
| 2,526,265 | A | * | 10/1950 | Nulph | 239/226 |
| 2,613,738 | A | * | 10/1952 | Bowman | 160/11 |
| 2,947,312 | A | * | 8/1960 | Heinicke | 134/191 |
| 3,325,976 | A | * | 6/1967 | West | 96/335 |
| 3,709,732 | A | | 1/1973 | Thomen | |
| 3,729,138 | A | * | 4/1973 | Tysk | 239/102.2 |
| 3,854,998 | A | * | 12/1974 | Jacobs | 134/191 |
| 5,485,828 | A | | 1/1996 | Hauser | |

FOREIGN PATENT DOCUMENTS

| | | | |
|---|---|---|---|
| CN | 1257689 | | 6/2000 |
| DE | 197 13 496 | | 10/1998 |
| EP | 0 396 363 | | 11/1990 |
| EP | 0 487 474 | | 5/1992 |
| EP | 1 309 751 | | 5/2003 |
| JP | 55-68576 | | 11/1978 |
| JP | 05-184511 | | 7/1993 |
| JP | 10-14844 | * | 1/1998 |
| JP | 11-346980 | * | 12/1999 |
| JP | 2003-174994 | | 6/2003 |
| JP | 2003-210378 | | 7/2003 |
| KR | 10-0228203 | | 11/1999 |

OTHER PUBLICATIONS

European Patent Office 0 487474 Nov. 1991.*

* cited by examiner

*Primary Examiner*—Frankie L Stinson
(74) *Attorney, Agent, or Firm*—Bacon & Thomas PLLC

(57) ABSTRACT

A dishwasher includes a washer tub for accommodating therein items to be cleaned, and a mist generating unit for generating a mist of wash water in the washer tub, the mist generating unit including a mist generating vibrator and a vibration transmitting medium. The vibration transmitting medium is provided on the mist generating vibrator so that the mist generating vibrator is isolated from wash water.

6 Claims, 3 Drawing Sheets

DISHWASHER

FIELD OF THE INVENTION

The present invention relates to a dishwasher for cleaning items such as kitchen and dining ware items by spraying wash water thereto.

BACKGROUND OF THE INVENTION

Referring to FIG. 3, there is illustrated a configuration of a conventional dishwasher.

As shown in FIG. 3, dishwasher main body 1 has washer tub 2 therein, and water or warm water is supplied into washer tub 2 by water supply valve 3. Here, the supply of wash water is automatically stopped by shutting water supply valve 3 once the water in washer tub 2 reaches an appropriate preset water level which is detected by a water level detector (not shown). Water drainage outlet 4 is disposed on the bottom portion of washer tub 2, and communicates with washing pump 5 driven by a motor for use in circulating wash water in washer tub 2. Further, strainer 6 for filtering particulate food debris from the wash water is installed in water drainage outlet 4.

The operation of a dishwasher in accordance with the above configuration will now be described. Wash water supplied in washer tub 2 is suctioned by washing pump 5 through strainer 6 and is then injected into wash nozzle 7 disposed in the lower portion of washer tub 2 from washing pump 5. Once wash water has been sprayed by wash nozzle 7 onto soiled items 8 to be cleaned (kitchen and dining ware), it is circulated back to water drainage outlet 4 through a water passageway. At this point, solid food particulates removed from items 8 to be cleaned are introduced into strainer 6 in wash water, and any debris too large to pass through strainer 6 are collected in strainer 6.

Further, heater 9 for heating wash water is disposed between wash nozzle 7 and the bottom portion of washer tub 2. Disposed above wash nozzle 7 is rack 10 for arranging items 8 to be cleaned therein in an orderly manner so they can be subjected to more effective spraying of wash water resulting in more efficient cleaning. Moreover, water drain pump 11 is for use in discharging wash water from the dishwasher. Controller 12 controls electrical components such as water supply valve 3 and washing pump 5 (see, for example, Japanese Patent Laid-Open Application No. 2003-210378).

However, the conventional dishwasher having the above configuration is not capable of removing all types of food debris. Particularly, heavy or stubborn debris which are dried-on or baked-on material remaining on kitchen ware items after preparing certain foods (e.g., gratin or savory streamed egg custard) cannot be removed by the conventional dishwasher.

To solve this problem, it has been proposed to add a prewashing step to allow more concentrated detergent solution to coat and remain on kitchen and dining items for a period of time. Adding this step improved the cleaning ability of the conventional dishwasher model, thereby enabling it to remove stubborn or heavy debris it could not before.

In this case, when using a mist generator having an ultrasonic vibrator to promote coating of high concentration detergent solution on kitchen or dining ware items to be cleaned, food debris in wash water or mineral dissolved in water with high hardness, (e.g., ground or well water), may deposit and harden thereafter on the vibrating surface of the ultrasonic vibrator. Consequently, such deposits affect the operation of the ultrasonic vibrator by deteriorating its power considerably or causing it to malfunction.

SUMMARY OF THE INVENTION

It is, therefore, an object of the present invention to provide a dishwasher capable of stably generating wash water mists in a washer tub containing wash water highly contaminated with, e.g., food debris, and capable of applying concentrated detergent solution evenly so that kitchen and dining items being washed are almost completely coated everywhere by the detergent, thereby resulting in obtaining greatly improved cleaning efficiency from the chemical strength of high-concentration detergent.

In order to achieve the above object, a dishwasher is configured to have a mist generating unit for generating mist of wash water in a washer tub for accommodating items to be cleaned therein. The mist generating unit includes a mist generating vibrator and a vibration transferring medium provided on the former so that the mist generating vibrator is isolated from wash water.

In accordance with a preferred embodiment of the present invention, there is provided a dishwasher including: a washer tub for accommodating therein items to be cleaned; and a mist generating unit for generating a mist of wash water in the washer tub, the mist generating unit including a mist generating vibrator and a vibration transmitting medium, wherein the vibration transmitting medium is provided on the mist generating vibrator so that the mist generating vibrator is isolated from wash water.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Figure 1:
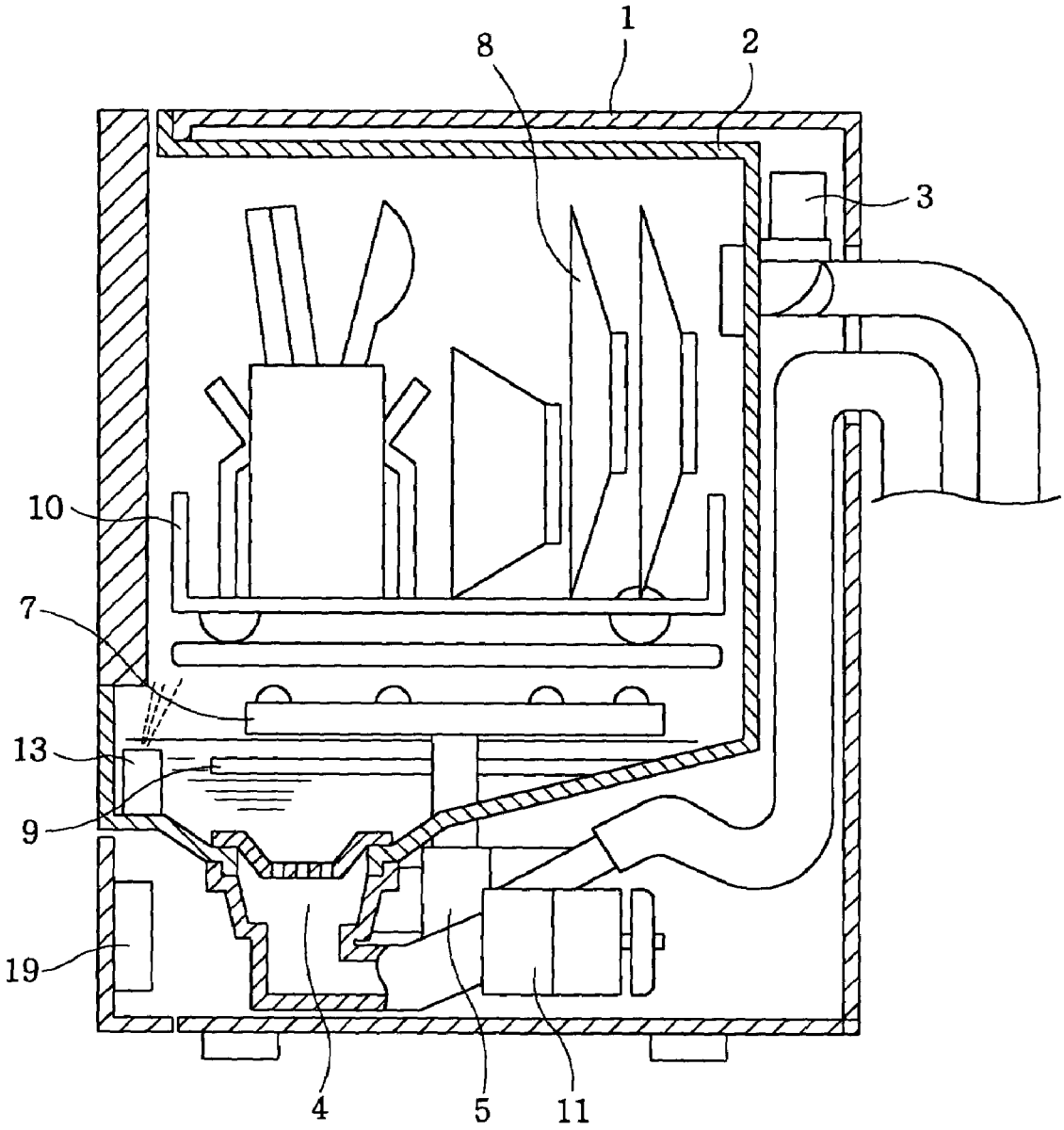
FIG. 1 is a vertical cross sectional view of a dishwasher in accordance with a preferred embodiment of the present invention.

Hereinafter, a preferred embodiment of the present invention will be described with reference to the accompanying drawings. Components identical or similar to those of the conventional dishwasher in FIG. 1 will be assigned same reference numerals, and description thereof will be omitted. Further, the present invention is not limited to the preferred embodiment.

Figure 2:
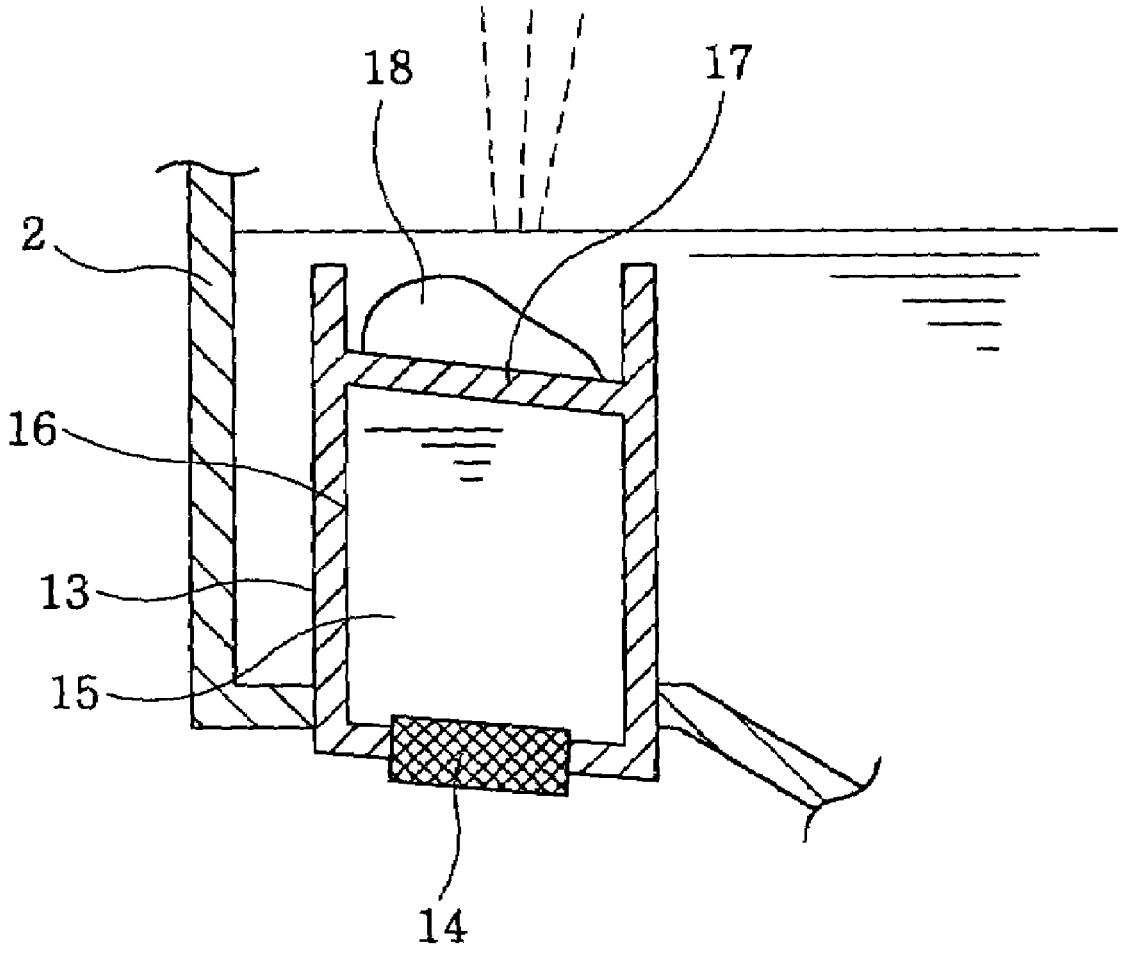
FIG. 2 is an enlarged cross sectional view of a major component of the dishwasher in accordance with the preferred embodiment of the present invention.
Figure 3:
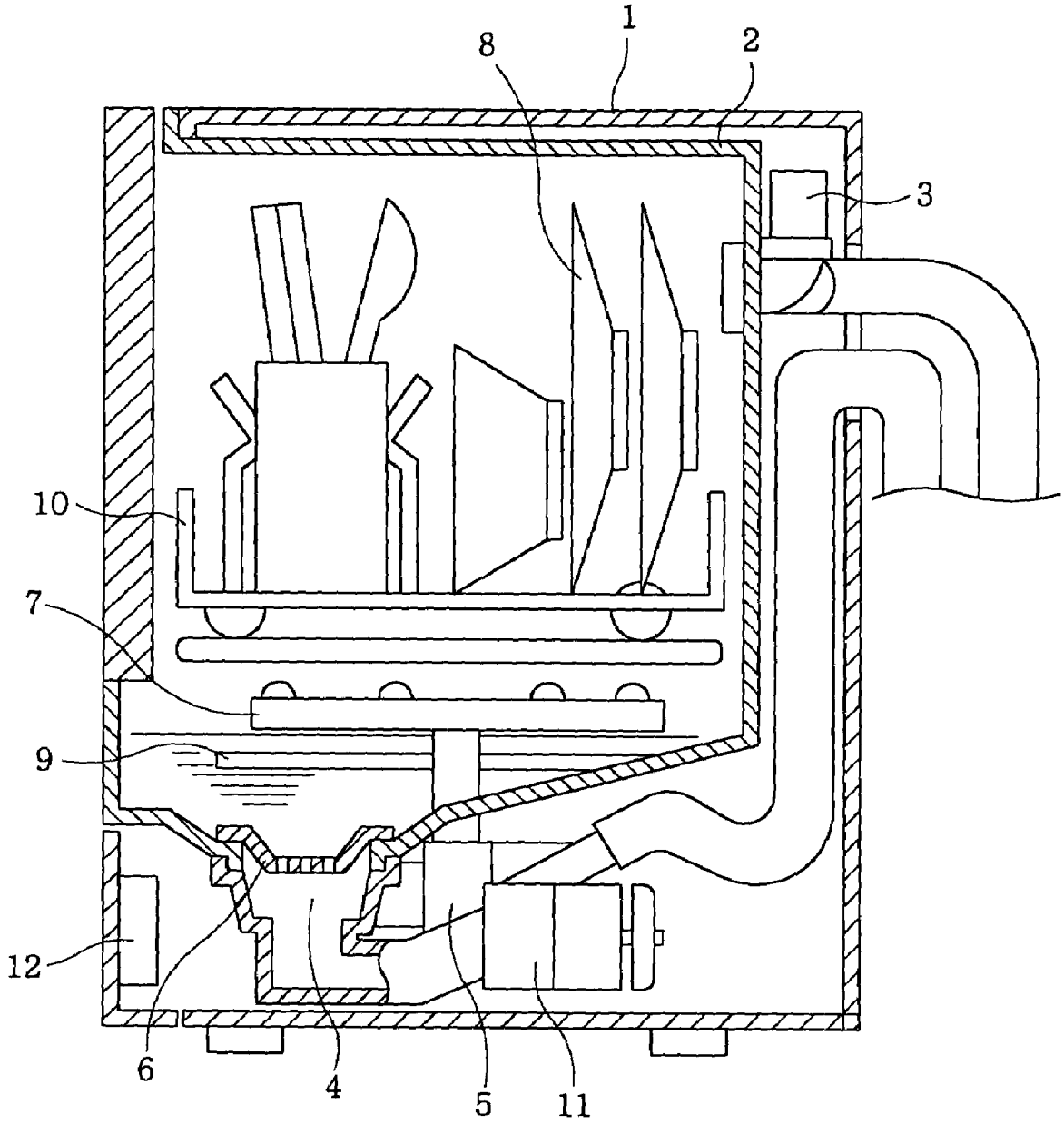
FIG. 3 (PRIOR ART)
FIG. 3 shows a vertical cross sectional view of a conventional dishwasher.

As shown in FIG. 1, mist generating unit 13 for generating mist of wash water in washer tub 2 is disposed at the lower front portion of washer tub 2. As can be seen in FIG. 2, mist generating unit 13 includes ultrasonic vibrator (mist generating vibrator) 14 disposed at the bottom portion thereof; and sealed vessel 16 containing therein fluid medium 15 resting on the vibrating surface of ultrasonic vibrator 14. Surface 17 of sealed vessel 16 which faces ultrasonic vibrator 14 is vibrated by ultrasonic vibrator 14 via fluid medium 15 and sealed vessel 16, both of which function as a vibration transmitting member jointly, to thereby generate mists of wash water in washer tub 2. In this embodiment, fluid medium 15 is distilled water.

In this case, surface 17 facing ultrasonic vibrator 14 is inclined and is formed of a resin which vibrates easily. Furthermore, detergent dispenser 18 for accommodating detergent therein is disposed over surface 17.

Controller 19 controls a series of operations including washing, rinsing, and drying processes in sequence as well as controlling the operation of water supply valve 3, washing pump 5, and so forth. Further, controller 19 activates mist generating unit 13 only when wash water reaches a level above surface 17 so that it stays submerged, and regulates the water level in washer tub 2 to be maintained always above surface 17 while mist generating unit 13 is operating.

The operation and function of the dishwasher having the above configuration will now be described. After loading detergent into detergent dispenser 18, the operation of the dishwasher is started. First, water supply valve 3 is opened, and a predetermined amount of wash water is supplied into washer tub 2. At this time, controller 19 sets and controls the water level such that detergent dispenser 18, i.e., the top of surface 17 facing ultrasonic vibrator 14 is submerged in water.

When wash water flows into detergent dispenser 18, detergent is dissolved in the wash water. When ultrasonic vibrator 14 is activated at that moment, its vibration is transmitted to surface 17 of sealed vessel 16 via fluid medium 15 and sealed vessel 16, to thereby vibrate surface 17. If surface 17 is positioned where the amplitude of ultrasonic vibrator 14 reaches its maximum, surface 17 can be vibrated greatly.

The vibration of surface 17 in turn causes the wash water resting above it to pulsate as well thereby generating mists of wash water while dissolving detergent added from detergent dispenser 18 in the wash water. As a result, the wash water highly concentrated with detergent is sprayed into washer tub 2 to coat items 8 to be cleaned. If the water level becomes lower so that surface 17 is exposed, the mist generation comes to a halt, and the detergent solution is no more dispersed. Therefore, controller 19 controls water supply valve 3 such that surface 17 stays submerged in water while ultrasonic vibrator 14 is operating.

In case air bubbles are generated in fluid medium 15 inside sealed vessel 16, while lying below surface 17, they would obstruct the transmission of vibration from ultrasonic vibrator 14 to surface 17. Therefore, surface 17 in accordance with the present invention is inclined so that the air bubbles are directed to stay away from the center of the transmission path of vibration.

A pre-washing step is performed prior to the main washing operation. As described above, by spraying a high-concentration detergent solution in washer tub 2 from mist generating unit 13, items 8 to be cleaned are coated with detergent solution, and this condition is maintained for a period of time. As a result, food debris remaining on items 8 to be cleaned is chemically disintegrated by the detergent solution.

During the main washing operation, the food debris disintegrated by the above pre-washing process for removing certain types of food debris through the use of high-concentration detergent solution is subjected to washing processes identical to those normally performed by a conventional dishwasher.

Food debris of items 8 to be cleaned can be more efficiently removed by increasing the temperature or the mechanical force of wash water (here, mechanical force referring to the power of jetting wash water from wash nozzle 7). Thus, although certain food debris is disintegrated through the pre-washing process, to further improve the cleaning efficiency of the washing machine, adjusting the temperature or the mechanical force of wash water is an option. However, disintegration of food debris by coating with high-concentration detergent and maintaining of the condition for a period of time during the pre-washing process has demonstrated its effectiveness for removing heavy or stubborn food debris which could not be handled by the conventional dishwasher.

With regard to mist generating unit 13 in accordance with the present invention, since sealed vessel 16 containing therein fluid medium 15 is disposed on the vibrating surface of ultrasonic vibrator 14 and surface 17 facing ultrasonic vibrator 14 is vibrated via fluid medium 15 and sealed vessel 16, ultrasonic vibrator 14 is completely isolated from wash water. That is, since ultrasonic vibrator 14 is prevented from contacting soiled wash water, food debris in the form of sludge is prevented from depositing and hardening thereafter on the vibrating surface of ultrasonic vibrator 14. As a result, the reliability of ultrasonic vibrator 14 has been considerably improved.

Further, in case of using hard water such as ground or well water, mineral dissolved in hard water would deposit on the vibrating surface of the ultrasonic vibrator 14. Thus, in areas with hard water supply, hard mineral deposits forming on the surface of the ultrasonic vibrator 14 would deteriorate its performance. However, by using mist generating unit 13 in accordance with the present invention, such problem can be avoided, so that mist generation of washing liquid can be stably carried out more reliably for an extended period of time.

As for mist generating unit 13 in accordance with the preferred embodiment of the present invention, since fluid medium 15 contained in sealed vessel 16 is disposed above ultrasonic vibrator 14 while being isolated from wash water directly, neither does ultrasonic vibrator 14 contact wash water. Therefore, it is possible to prevent the problems arising from hardened deposits of foreign substances on the vibrating surface of ultrasonic vibrator 14. Further, the problems of deteriorating the performance of ultrasonic vibrator 14 by such hardened deposits, causing a considerable reduction in the amount of mist generated or rendering ultrasonic vibrator 14 inoperable. As a result, mist generation of wash water can be reliably carried out even in wash water heavily contaminated with, e.g., food debris in washer tub 2. Further, since it is possible to spray more highly concentrated detergent solution to coat soiled kitchen or dining ware items 8 almost completely and evenly, cleaning efficiency can be greatly improved from the chemical effect of the high-concentration detergent.

Further, since mist generating unit 13 is provided with sealed vessel 16 containing therein fluid medium 15 on the side of the vibrating surface of ultrasonic vibrator 14, ultrasonic vibrator 14 is prevented from contacting wash water directly by sealed vessel 16. Therefore, foreign substances cannot reach the vibrating surface of ultrasonic vibrator 14 which in turn does not form hardened deposits thereon, so that it possible to stabilize the generation of mists even in soiled wash water.

In addition, since controller 19 activates mist generating unit 13 only after supplying wash water to a level above surface 17, there is always a supply of wash water above surface 17 to be sprayed, thereby maintaining stable mist generation.

Further, since controller 19 always regulates the water level in washer tub 2 to be maintained above surface 17 while mist generating unit 13 is operating, surface 17 is always kept submerged in wash water, thereby allowing stable mist generation.

Still further, since surface 17 which faces ultrasonic vibrator 14 is inclined in mist generating unit 13, air bubbles that might be generated in fluid medium 15 in sealed vessel 16 can be prevented from gathering below or adhering to surface 17, so that stable mist generation can be assured.

Also, with regard to mist generating unit 13, since surface 17 which faces ultrasonic vibrator 14 is made of resin, it is possible to obtain stable vibrations by way of utilizing a resin material capable of producing a vibrational state similar to that of fluid medium 15 in sealed vessel 16. As a result, stable mist generation can be maintained.

Further, with regard to mist generating unit 13, since detergent dispenser 18 is disposed in the vicinity of surface 17, it becomes possible to spray a detergent solution, which is of a concentration higher than that for use in a normal washing operation, to coat items 8 to be cleaned almost completely, to thereby improve the cleaning efficiency greatly by virtue of the chemical strength of the high-concentration detergent coating items 8.

Although distilled water is used as fluid medium 15 in the preferred embodiment of the present invention, any kind of liquid capable of transmitting vibration, e.g., saline water, can be used instead. Further, though surface 17 of mist generating unit 13 is made of a resin which tends to vibrate easily, it is also possible to form surface 17 even with a metal as long as it vibrates by the influence of ultrasonic vibrator 14.

Further, instead of installing detergent dispenser 18 at mist generating unit 13, it is also possible to produce a high-concentration detergent solution by supplying wash water from wash supply valve 3 while dissolving detergent therein through a hose during a pre-washing operation and to generate mist of the high-concentration detergent solution to be attached to items 8 to be cleaned.

As described above, the dishwasher in accordance with the present invention is capable of stably generating mist of wash water even in case the wash water is heavily soiled with, e.g., food debris in the washer tub and capable of allowing a detergent solution with a concentration higher than that for use in a normal washing operation to almost completely coat the items to be cleaned, to thereby greatly improve cleaning efficiency by virtue of chemical effect of the high-concentration detergent clinging to the items to be cleaned. Thus, the present invention can offer advantages when it is applied to a dishwasher for washing items to be cleaned such as dishware by way of spraying wash water.

While the invention has been shown and described with respect to the preferred embodiment, it will be understood by those skilled in the art that various changes and modifications may be made without departing from the sprit and scope of the invention as defined in the following claims.

What is claimed is:

1. A dishwasher comprising:

a washer tub for accommodating therein items to be cleaned;

a mist generating unit for generating a mist of wash water in the washer tub, the mist generating unit including a mist generating vibrator and a vibration transmitting medium wherein the mist generating unit includes a sealed vessel accommodating therein a fluid on the side of a vibrating surface of the mist generating vibrator, and the vibration transmitting medium is provided on the mist generating vibrator so that the mist generating vibrator is isolated from wash water.

2. The dishwasher of claim 1, further comprising a water supply unit for supplying wash water into the washer tub and a controller for controlling the level of wash water in the washer tub, wherein the controller operates the mist generating unit after wash water is supplied up to a level where the mist generating unit's surface which faces the mist generating vibrator is submerged in wash water.

3. The dishwasher of claim 2, wherein the controller maintains the water level in the washer tub above the surface of the mist generating unit while the mist generating unit is operating.

4. The dishwasher of claim 1, wherein the mist generating unit further includes a surface facing the mist generating vibrator, the surface being inclined.

5. The dishwasher of claim 1, wherein the mist generating unit further includes a surface facing the mist generating vibrator, the surface being formed of a resin.

6. The dishwasher of claim 1, wherein the mist generating unit further has a detergent dispenser for accommodating a detergent therein and installed in the vicinity of a surface which faces the mist generating vibrator.

* * * * *